United States Patent [19]

Brown

[11] 3,973,403

[45] Aug. 10, 1976

[54] CLOSED CYCLE STEAM TURBINE SYSTEM WITH LIQUID VORTEX PUMP

[76] Inventor: Kenard D. Brown, 1227 S. Willow St., Casper, Wyo. 82601

[22] Filed: Aug. 12, 1974

[21] Appl. No.: 496,815

[52] U.S. Cl. ..... 60/688; 60/689

[51] Int. Cl.[2] ..... F01K 19/00

[58] Field of Search ..... 60/688, 689; 261/DIG. 32, DIG. 10, 90, 93; 415/72–74, 116, 143

[56] References Cited

UNITED STATES PATENTS

| | | | |
|---|---|---|---|
| 196,759 | 11/1877 | Miller | 60/675 |
| 1,331,110 | 2/1920 | Hutchens | 60/639 |
| 1,400,813 | 12/1921 | Graemiger | 415/116 |
| 3,204,861 | 9/1965 | Brown | 261/93 |
| 3,490,996 | 1/1970 | Kelly, Jr. | 60/641 X |
| 3,680,975 | 8/1972 | Smith et al. | 415/74 |

FOREIGN PATENTS OR APPLICATIONS

| | | | |
|---|---|---|---|
| 657,020 | 2/1949 | United Kingdom | 60/689 |
| 920,138 | 3/1963 | United Kingdom | 415/74 |

*Primary Examiner*—Allen M. Ostrager

[57] ABSTRACT

A closed cycle steam generating system comprising a steam boiler and a steam turbine includes a vacuum pump of the liquid vortex type for condensing the exhaust steam from the turbine, a feedwater pump being employed for returning the condensate to the boiler. The tank of the vortex pump is maintained filled with water and the pressure in the tank is regulated automatically to maintain a predetermined value thereof.

6 Claims, 3 Drawing Figures

CLOSED CYCLE STEAM TURBINE SYSTEM WITH LIQUID VORTEX PUMP

My invention relates to closed cycle steam turbine systems and particularly to an improved system employing a vacuum pump of the liquid vortex type for condensing the steam exhausted from the turbine.

The term "vacuum pump of the liquid vortex type" as used herein has reference to a pump of the type disclosed in my U.S. Pat. No. 3,812,654 issued May 28, 1974.

The operation of steam turbine electric power generating systems involves the requirement for the dissipation of great quantities of heat. The condenser of such systems require large volumes of cooling water and it is a frequent practice to pump the water from a stream or river and then return it after it has served to cool the condensers of the system. In this manner warm or hot water is delivered to the stream and has deleterious effects upon the fish and vegetation of the stream. It is highly desirable to avoid such heat pollution of rivers and ocean bays. Accordingly, it is an object of my invention to provide a closed steam turbine system including an improved arrangement for minimizing the requirements for cooling water.

It is another object of my invention to provide a closed cycle steam turbine system including an improved arrangement for maintaining the low pressure required at the turbine exhaust.

It is a further object of my invention to provide a closed cycle steam generating system including an improved arrangement for eliminating the need for large cooling towers.

It is still a further object of my invention to provide an improved closed cyle steam power generating system.

Briefly, for carrying out the objects of my invention in one embodiment thereof a closed steam turbine electric power generating system comprises a steam boiler delivering high pressure high temperature steam to a turbine connected to drive an electric power generator, and a high volume vacuum pump of the liquid vortex type is connected to receive the exhaust steam and condense it in the water of the pump, the pump tank pressure being controlled and the water being returned through a feedwater pump to the boiler. To increase the condensing effect of the pump a portion of the water from the tank is passed through an air cooler and delivered as a spray into the steam in the pump intake chamber.

The features of novelty which characterize my invention are pointed out with particularity in the claims annexed to and forming a part of this specification. My invention itself, however, both as to its organization, together with further objects and advantages thereof, and its manner of operation will best be understood upon reference to the following description taken in connection with the accompanying drawings, in which:

Figures 1, 2:
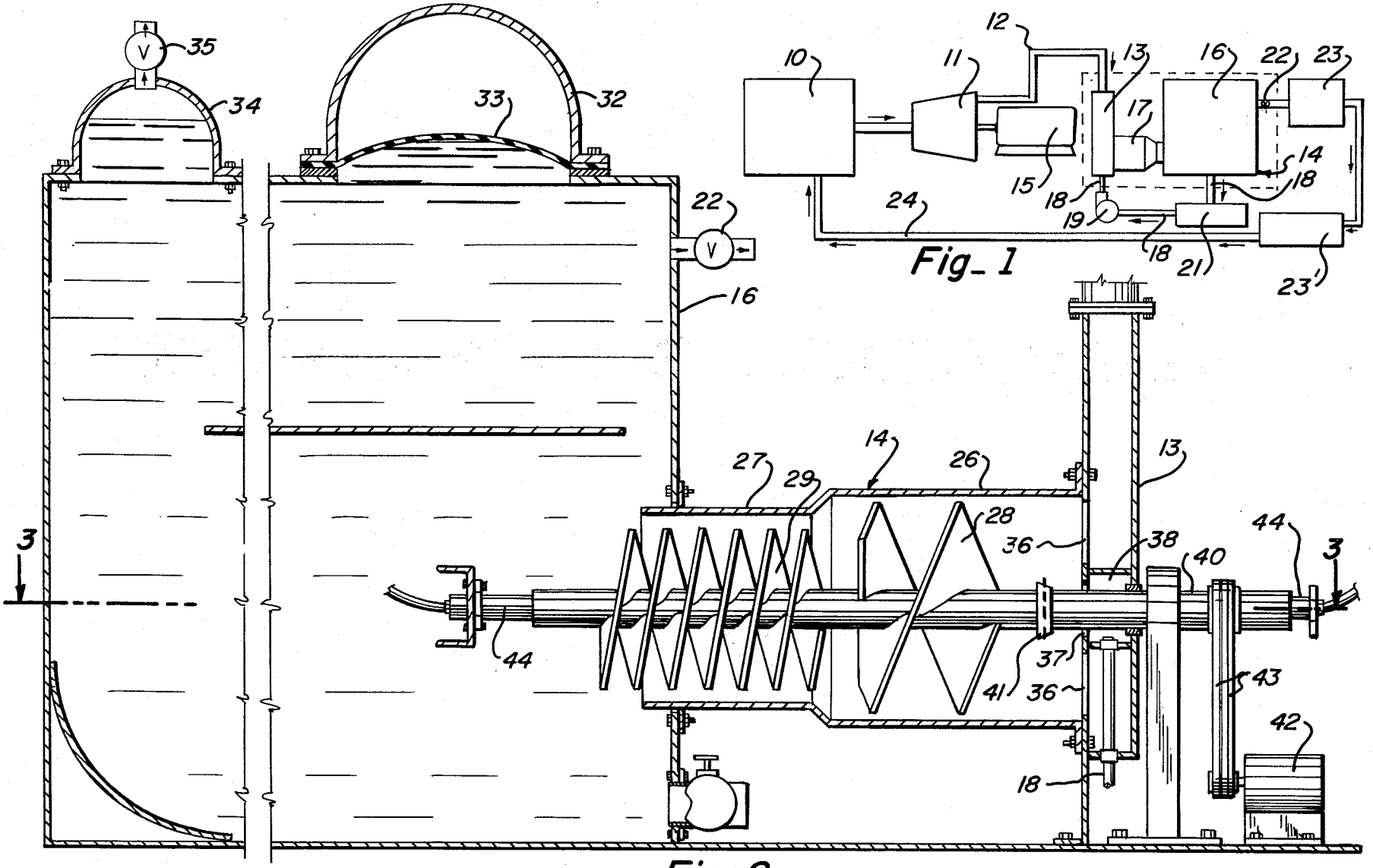
FIG. 1 is a diagrammatic illustration of a closed cycle steam power system embodying my invention.
FIG. 2 is a sectional plan view of a vacuum pump of the liquid vortex type embodying feature of my invention; and, FIG. 3 is a sectional plan view taken generally along the line 3—3 of FIG. 2.

Referring now to the drawings, the power generating system illustrated in FIG. 1 comprises a steam boiler 10 which includes the usual coal or oil burning equipment for providing the necessary heat, a steam turbine 11 connected to receive steam from the boiler 10 and deliver exhausted steam to a conduit 12 to a fluid supply duct 13 of a vacuum pump 14 of the liquid vortex type. Operation of the turbine 10 drives electric generator 15 in the usual manner. The vortex pump 14 includes a closed tank and the vortex pump unit 17. Operation of the vortex pump which is driven by a suitable electric motor or other engine (not shown) draws fluids from the duct 13 and drives the steam and any liquid therein to the pump 17 in which is formed the liquid vortex and which compresses the gaseous fluids and condenses them and drives them into the tank 16. The steam is cooled and shrunk as it passes through the initial portion of the vortex pump and in order to increase the cooling action, water is removed from the tank 16 through a connection 18 and driven by a pump 19 from the tank into the duct 13; this water is passed through an air cooler 21 which lowers its temperature to increase its cooling action when introduced as a spray into the gaseous fluid within the intake chamber of the pump 17. The steam is condensed and enters the tank 16 in which the pressure is maintained at a preselected value by operation of an automatic valve 22 at the liquid outlet of the tank. The details of construction of the vortex pump will be described below in connection with FIGS. 2 and 3 of the drawings. A surge chamber 23 is provided to receive the liquid delivered through the control valve 22 and the liquid is removed from the surge chamber by operation of the feed water pump 23' which delivers the water through a supply pipe or conduit 24 to the boiler 10 to complete the closed circuit. During the operation of the system the valve 22 may be regulated, for example, to maintain the pressure of say 5 pounds within the tank 16 and the water in the tank will be at a temperature of on the order of 162°F.

Figure 3:
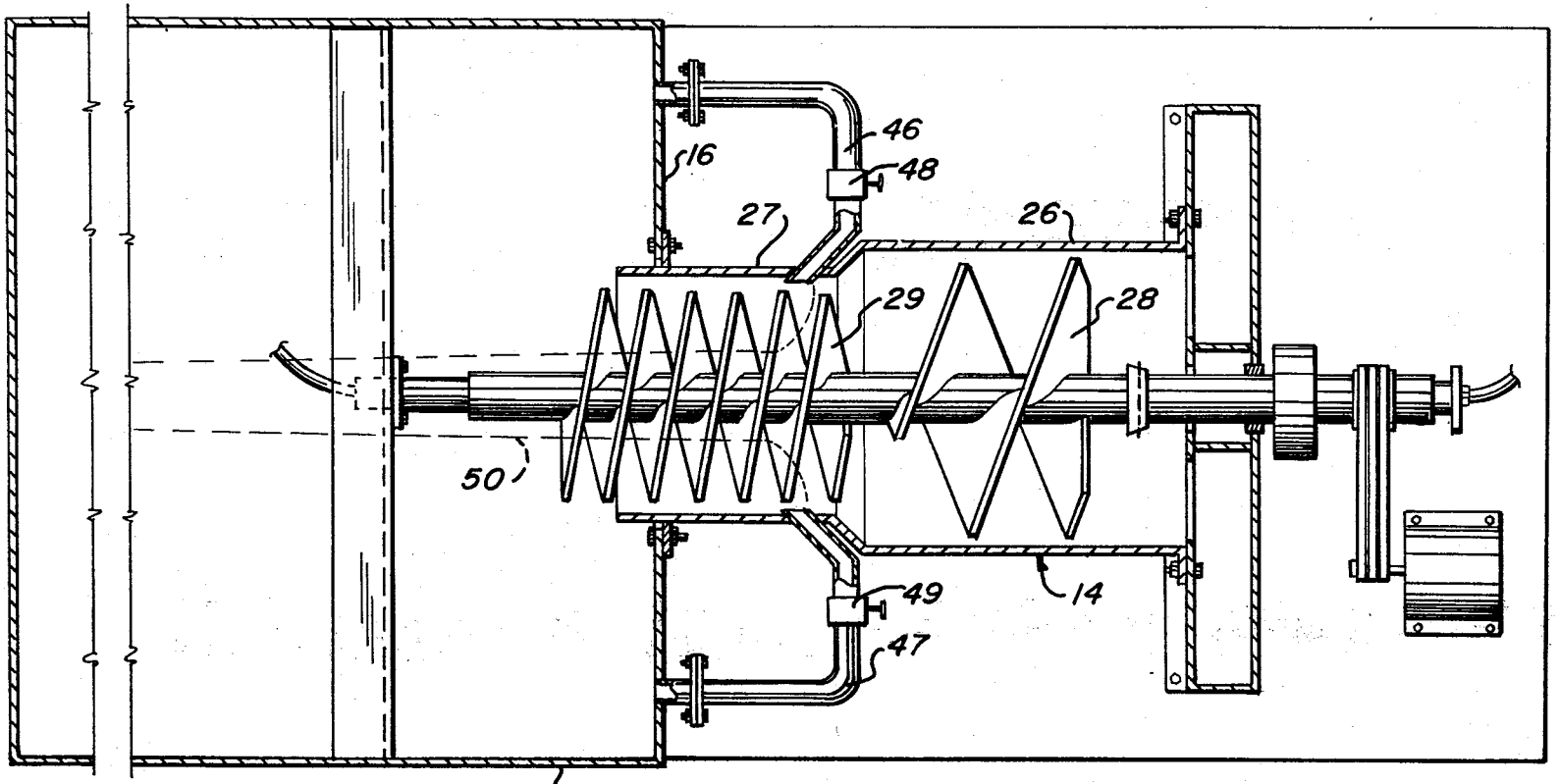

The details of construction of the vortex pump 16 are shown in FIGS. 2 and 3. The pump 14 comprises a cylindrical shroud having an intake portion 26 and a discharge portion 27 of reduced diameter. The portion 27 is securely mounted in an opening in the walls of the tank 16 and a two stage rotor comprising a first stage helical member 28 and a second stage helical member 29 is mounted.

Referring now to the drawings there is illustrated in FIGS. 2 and 3 a vacuum pump of the liquid vortex type which embodies the construction disclosed and claimed in my U.S. Pat. No. 3,812,654, issued May 28, 1974.

The pump 14 and the arrangement of the tank 16 are essentially the same as that in the patent; however, cooling fins have been omitted from the shroud 26.

The pump 14 operates in essentially the same way as that of the patent; however, the operation is controlled by the regulating valve 22 and a surge chamber comprising a dome 32 and a flexible diaphragm 33 which is filled with inert gas such as nitrogen and the like, located at the top of the tank above the discharge outlet so that the tank is maintained completely filled with water. The exhaust steam from the turbine under normal operation is saturated steam with low air or other gas present. In the event that non-condensible gases should collect over a period of operation of the system, they will tend to collect in a dome 34 near the left-hand end of the tank above the upward turn of the circulating water and from which they may be removed by opening a valve 35 to discharge such gas to the atmosphere.

The operation of the pump draws the exhaust steam into the duct 13 and it flows into the shroud 26 through openings 36. At the same time cooled water from the cooler 21 by the pump 19 is discharged through an axial opening 37 from an annular chamber 38 within the duct 13 about the shaft of the rotors 28 and 29 indicated at 40 and such water is thrown outwardly by action of the slinger ring indicated at 41. This produces a spray of water within the intake chamber of the pump and the steam cooled by this water spray and shrunk in volume thereby is pumped by operation of the helix 28 so that the mixture of water and steam is forced into the liquid vortex formed by rotation of the helical rotor 29. Operation of the pump compresses and condenses the steam and introduces it to the vortex flow into the body of water in the tank 16. The pressure in the tank 16 may be maintained at values selected by operation of the valve 22, water being removed as required to maintain the pressure and the diaphragm 33 allowing expansion and contraction to facilitate the maintaining of the selected pressure.

The vacuum pump is operated continuously by energization of said electric motor 42 connected through belts or preferably chains 43 to drive a shaft 40. The shaft 40 is a hollow shaft mounted on a fixed shaft 44 on suitable bearings not illustrated. The details of construction of the shaft and its lubricating arrangement are not essential to an understanding of the present invention; however, they are described in detail in my above mentioned patent. The pump is operating continuously during operation of the turbine and condenses the full output of exhaust steam, the condensed water being returned to the boiler 10 continuously through the pipe or conduit 24 by operation of the pump 23.

Applicant's system operates to condense the exhausted steam at temperatures substantially above those required for condensation and cooling towers. At the same time the heat lost in the cooling tower operation is maintained within the system, the heated water from the tank 16 being returned as feedwater to the boiler. It is thus not necessary to discharge heated water to ponds, streams, saltwater inlets or the like. My invention has therefore made possible the elimination of heat pollution due to the operation of power generating plants.

The controlling of the vacuum pump 14 to maintain optimum operating conditions is effected by controlling the return of the recirculation of water from the tank 16 to the shroud 27 through conduits illustrated as two conduits 46 and 47 in FIG. 3, these conduits being provided with control valves 48 and 49, respectively, for regulating the amount of recirculated water. Recirculation of water through the conduits 46 and 47 determines the characteristics of the liquid orifice indicated generally by dotted lines 50 in FIG. 3. As illustrated the first turn or turn and one-half of the rotor 29 lies on the inlet side of the orifice and thus the mass of mixed steam and water pumped forward by operation of the helix rotor 28 is further forced into the liquid vortex by operation of this first turn or turn and a half of the second stage rotor 29. The regulation of the flow through the conduits 46 and 47 will shape the vortex and determine the length of the rotor 29 which will lie outside the vortex proper. By the regulation of the flow through the recirculating conduits and of the pressure maintained within the tank 16, the effective capacity of the vacuum pump may be controlled and matched to the optimum handling of the exhaust gases from the turbine 11.

While I have described my invention in connection with a particular arrangement of a turbine driven power plant, other applications and modifications will occur to those skilled in the art. Therefore, I do not desire my invention to be limited to the details which I have illustrated and described and I intend by the appended claims to cover all modifications which fall within the spirit and scope of my invention.

I claim:

1. A closed cycle steam turbine system comprising:

a. a steam generating boiler;

b. a steam turbine connected to receive steam from said boiler;

c. a vacuum pump of the liquid vortex type including a tank for holding a body of water and connected to receive exhaust steam from said turbine and to condense such steam and mix it with said body of water; and, d. means for returning water from said pump to said boiler.

2. A closed cycle steam turbine system as set forth in claim 1 including means for removing a portion of the water in said pump and returning it to the intake of said pump for mixture with the exhaust steam received from said turbine, and means for cooling said removed portion of water prior to its admission to the intake of said pump.

3. A closed cycle steam turbine system as set forth in claim 1 including means for maintaining a predetermined pressure of the water contained in said pump, said means including a surge chamber for receiving water discharged from said pump and wherein said means for forcibly returning water is a feedwater pump for supplying water from said chamber to said boiler.

4. A closed cycle steam turbine system as set forth in claim 1 wherein:

said pump comprises a two step helical blade rotor, the first stage being positioned to operate in the intake zone of the pump and the second stage to produce a liquid vortex in the water in said tank;

means for supplying the exhaust steam to said intake zone and means for spraying water into said zone, said first stage compressing the steam and delivering it to the vortex of said second stage; and, said second stage condensing the steam and delivering the resulting condensate to the body of water in said tank.

5. A closed cycle steam turbine system as set forth in claim 4 wherein said means for spraying water into said intake zone comprises a pump for delivering water from said tank to said intake zone, and means for cooling the water during its passage from said tank to said intake zone.

6. A closed cycle steam turbine system as set forth in claim 4 including means for controlling the pressure in said tank and means for delivering water from said tank to said boiler.

* * * * *